US012545477B2

(12) United States Patent
Zammori et al.

(10) Patent No.: US 12,545,477 B2
(45) Date of Patent: Feb. 10, 2026

(54) CAP PROVIDED WITH A TAMPER EVIDENT SEAL

(71) Applicant: GUALA PACK S.P.A., Castellazzo Bormida (IT)

(72) Inventors: Riccardo Zammori, Castellazzo Bormida (IT); Alberto Buzzi, Castellazzo Bormida (IT)

(73) Assignee: Guala Pack S.P.A., Castelazzo Bormida (IT)

( * ) Notice: Subject to any disclaimer, the term of this patent is extended or adjusted under 35 U.S.C. 154(b) by 287 days.

(21) Appl. No.: 18/560,704

(22) PCT Filed: Mar. 7, 2022

(86) PCT No.: PCT/IB2022/051992

§ 371 (c)(1),
(2) Date: Nov. 14, 2023

(87) PCT Pub. No.: WO2022/243755

PCT Pub. Date: Nov. 24, 2022

(65) Prior Publication Data

US 2024/0253866 A1 Aug. 1, 2024

(30) Foreign Application Priority Data

May 21, 2021 (IT) ..... 102021000013271

(51) Int. Cl.
*B65D 41/34* (2006.01)
*B65D 47/12* (2006.01)
*B65D 75/58* (2006.01)

(52) U.S. Cl.
CPC ..... *B65D 41/3409* (2013.01); *B65D 47/122* (2013.01); *B65D 75/5883* (2013.01); *B65D 2575/586* (2013.01)

(58) Field of Classification Search
CPC ..... B65D 41/3409; B65D 47/122; B65D 75/5883; B65D 2575/586; B65D 41/3404
See application file for complete search history.

(56) References Cited

U.S. PATENT DOCUMENTS

2009/0223963 A1* 9/2009 Bisio ..... B65D 41/3433 220/304
2016/0122095 A1* 5/2016 Berge ..... B65D 55/022 222/566
2017/0327278 A1* 11/2017 Berge ..... B65D 75/008
2018/0170626 A1* 6/2018 Kwon ..... B65D 41/3404
2019/0084735 A1* 3/2019 Berge ..... B65D 47/122
2024/0253866 A1* 8/2024 Zammori ..... B65D 47/122

FOREIGN PATENT DOCUMENTS

KR 200489196 Y1 * 5/2019 ..... B65D 75/5883
WO 2008050361 A1 5/2008

OTHER PUBLICATIONS

International Search Report for International Patent Application No. PCT/IB2022/051992, mailed Jun. 29, 2022.

* cited by examiner

*Primary Examiner* — Bob Zadeh
(74) *Attorney, Agent, or Firm* — Armstrong Teasdale LLP

(57) ABSTRACT

A cap for a spout of a thin-walled flexible package having a tamper evident seal formed by a plurality of main sections is provided. Each main section of the plurality of main sections has a tooth for engaging a respective fixed ridge of the spout. The tooth radially projects inward and consists of a sharp solid element having a tooth height greater than a height of a remaining part of the main section.

21 Claims, 10 Drawing Sheets

CAP PROVIDED WITH A TAMPER EVIDENT SEAL

CROSS-REFERENCE TO RELATED APPLICATION

This application is a National Stage Application of International Patent Application No. PCT/IB2022/051992, having an International Filing Date of Mar. 7, 2022, which claims priority to Italian Application No. 102021000013271, filed May 21, 2021, the entire contents of each of which are hereby incorporated by reference herein.

FIELD OF THE INVENTION

The present invention relates to the field of flexible thin-walled packaging provided with a spout, usually referred to as "spouted pouch." In particular, the present invention relates to a cap for a spout of said package, provided with a tamper evident seal capable of highlighting the first opening thereof.

BACKGROUND OF THE INVENTION

Such packages, used above all to contain food products, such as fruit juices and purees, yogurts, energy drinks and the like, are particularly appreciated for the convenience and appreciation they have among children, who appreciate the playful aspect linked to the use of the spout. Currently, several hundreds of millions of pieces are marketed every year.

In this context, it is essential that the cap is provided with a tamper evident seal, so that the consumer may be sure that the package has not already been opened and that, consequently, the product is optimally preserved and not polluted by foreign substances.

The Applicant has been producing and marketing for years the cap called BabyCap, described in the International Application WO-A1-2008/050361. Such solution is particularly appreciated since the tamper evident seal, once broken, makes it clear that the first opening has taken place, but at the same time the portions f the seal that have detached from the breakable bridges remain constrained to the cap body.

The Applicant has now found that in some circumstances, for example in conditions of low temperatures, such as may occur when the package contains an iced product, such as an ice cream, some fragments of the tamper evident seal, when this is broken, may become detached.

SUMMARY OF THE INVENTION

The object of the present invention is to provide a cap for a spout, in particular for a thin-walled flexible package which overcomes the drawbacks mentioned above and meets the needs of the sector.

Such object is achieved by a cap as described and claimed herein. Advantageous embodiments of the present invention are also described.

BRIEF DESCRIPTION OF THE FIGURES

The features and the advantages of the cap according to the present invention will appear more clearly from the following description, made by way of an indicative and non-limiting example with reference to the drawings of the accompanying figures, in which.

DETAILED DESCRIPTION

Figure 1:
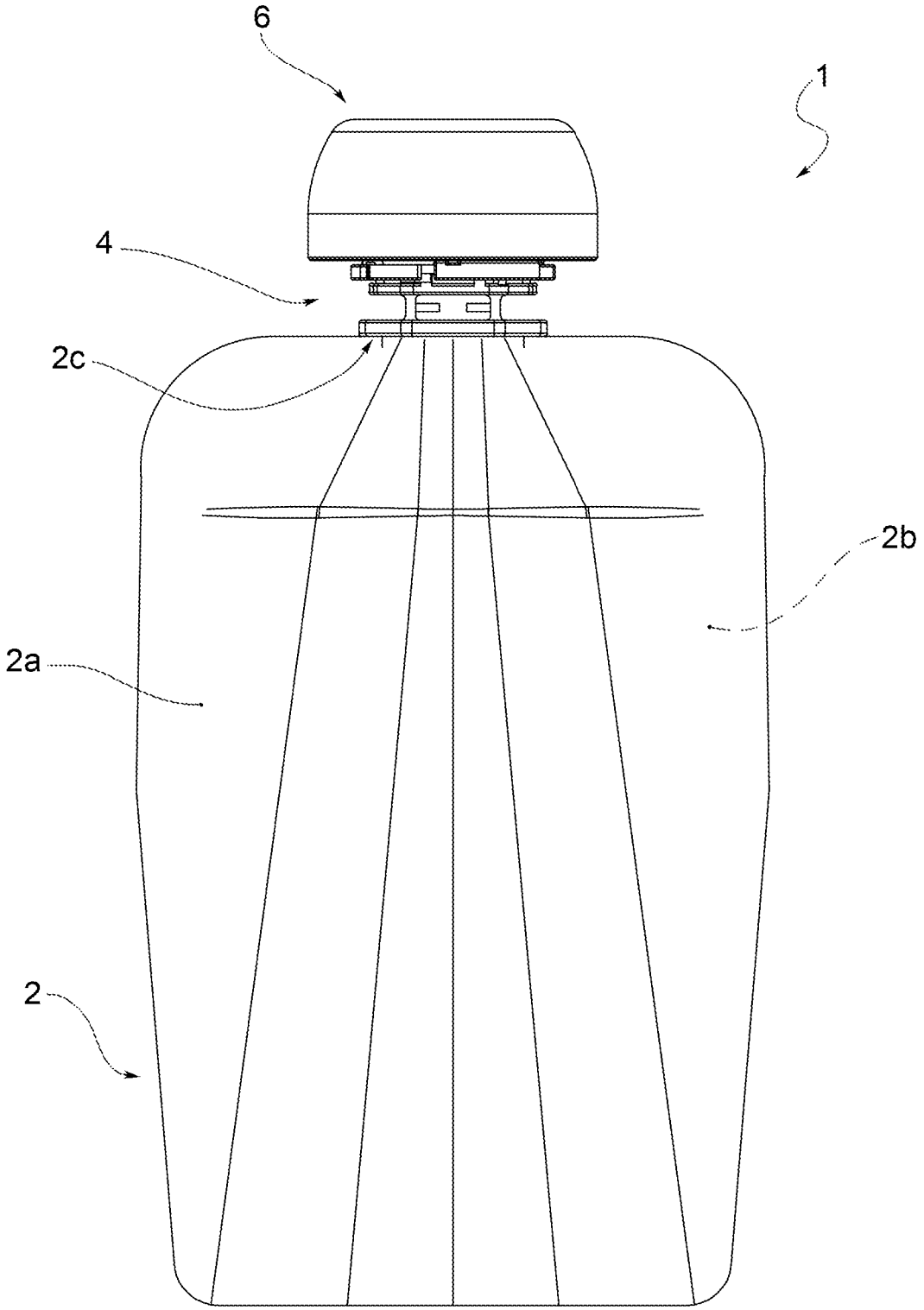
FIG. 1 shows a package comprising a bag, a spout part and a cap, according to an embodiment of the present invention.
Figure 2A:
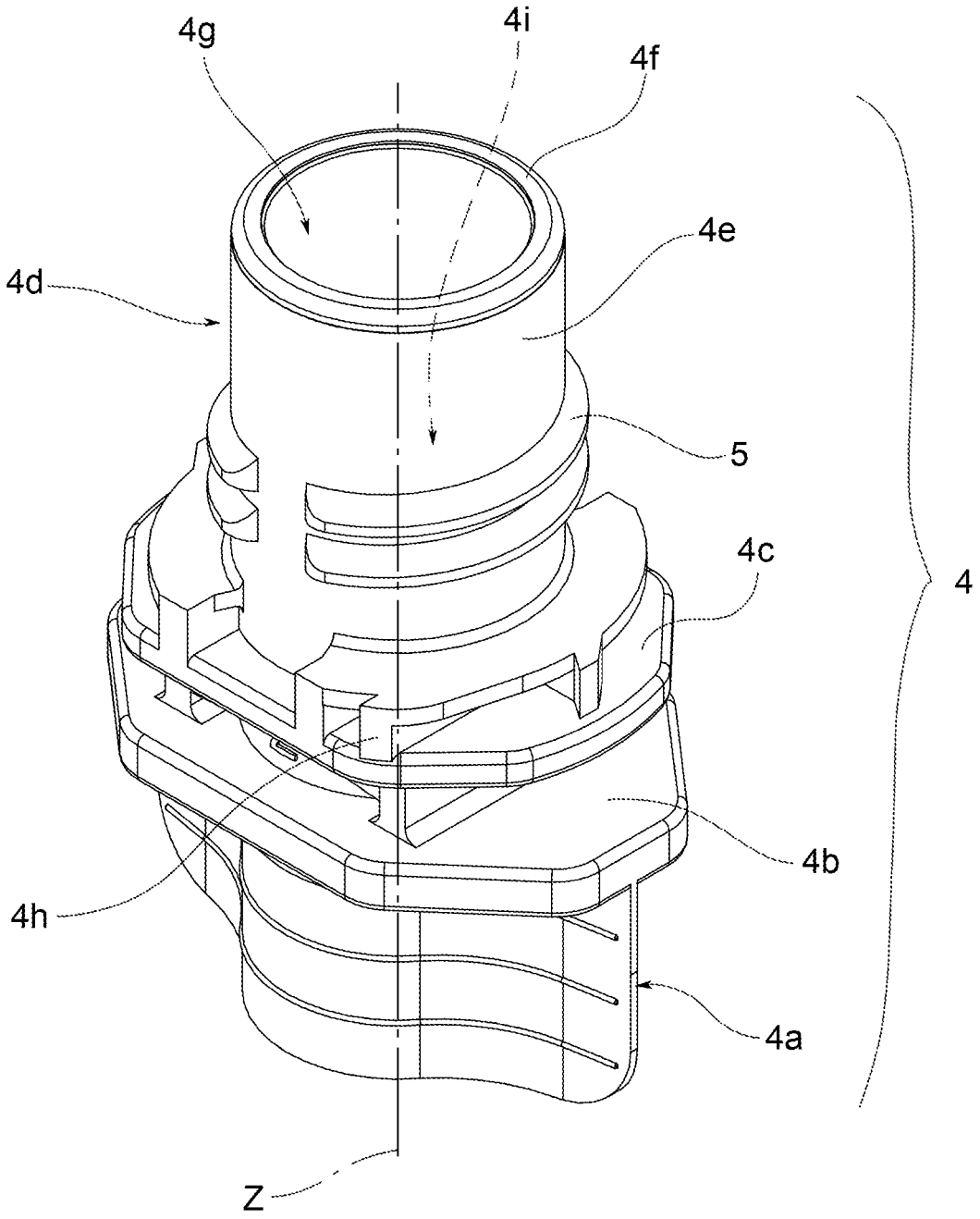
FIG. 2*a* shows the spout part of the package of FIG. 1.
Figure 2B:
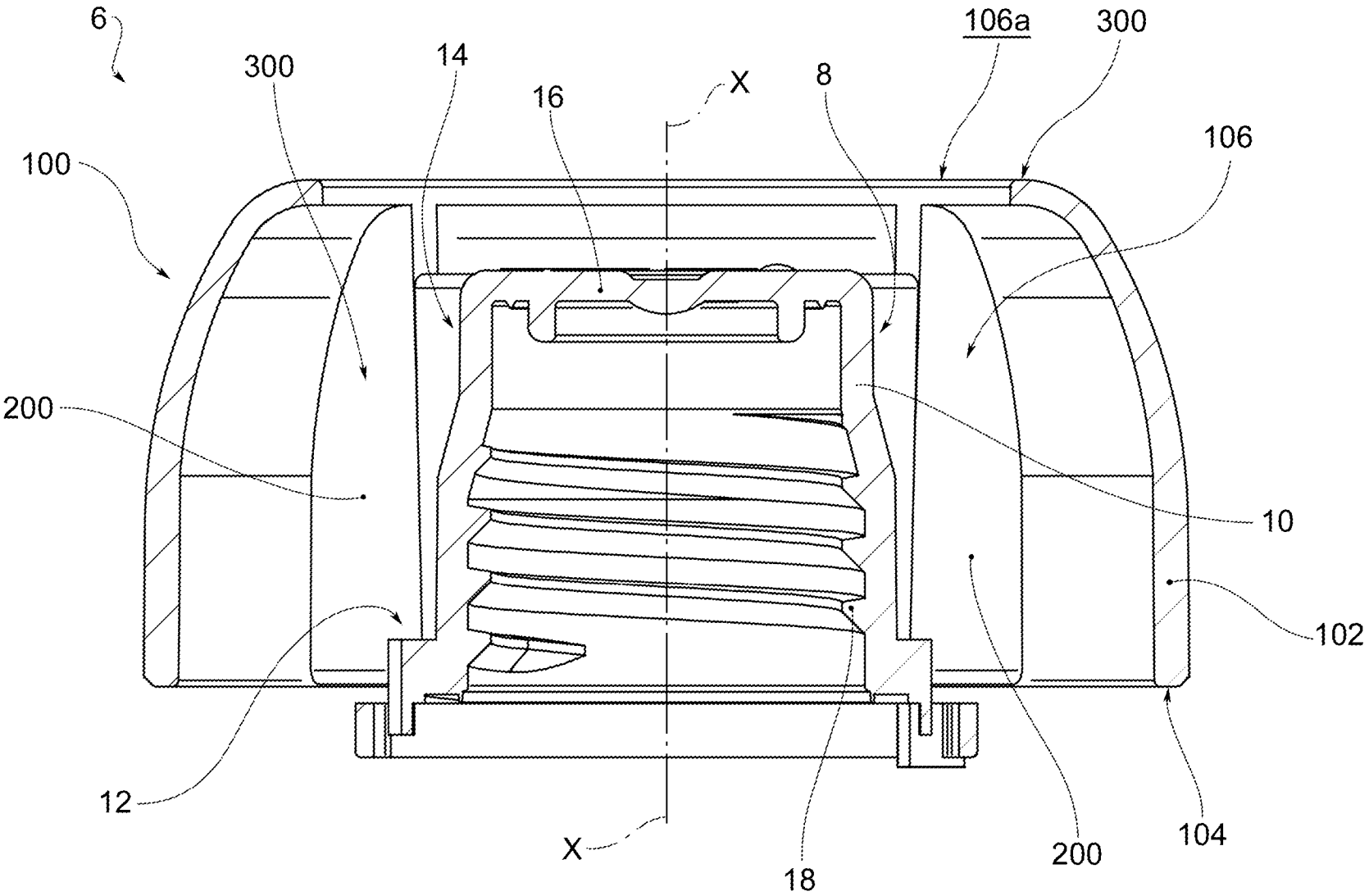
FIG. 2*b* shows a longitudinal sectional view of the cap of the package of FIG. 1.
Figure 3:
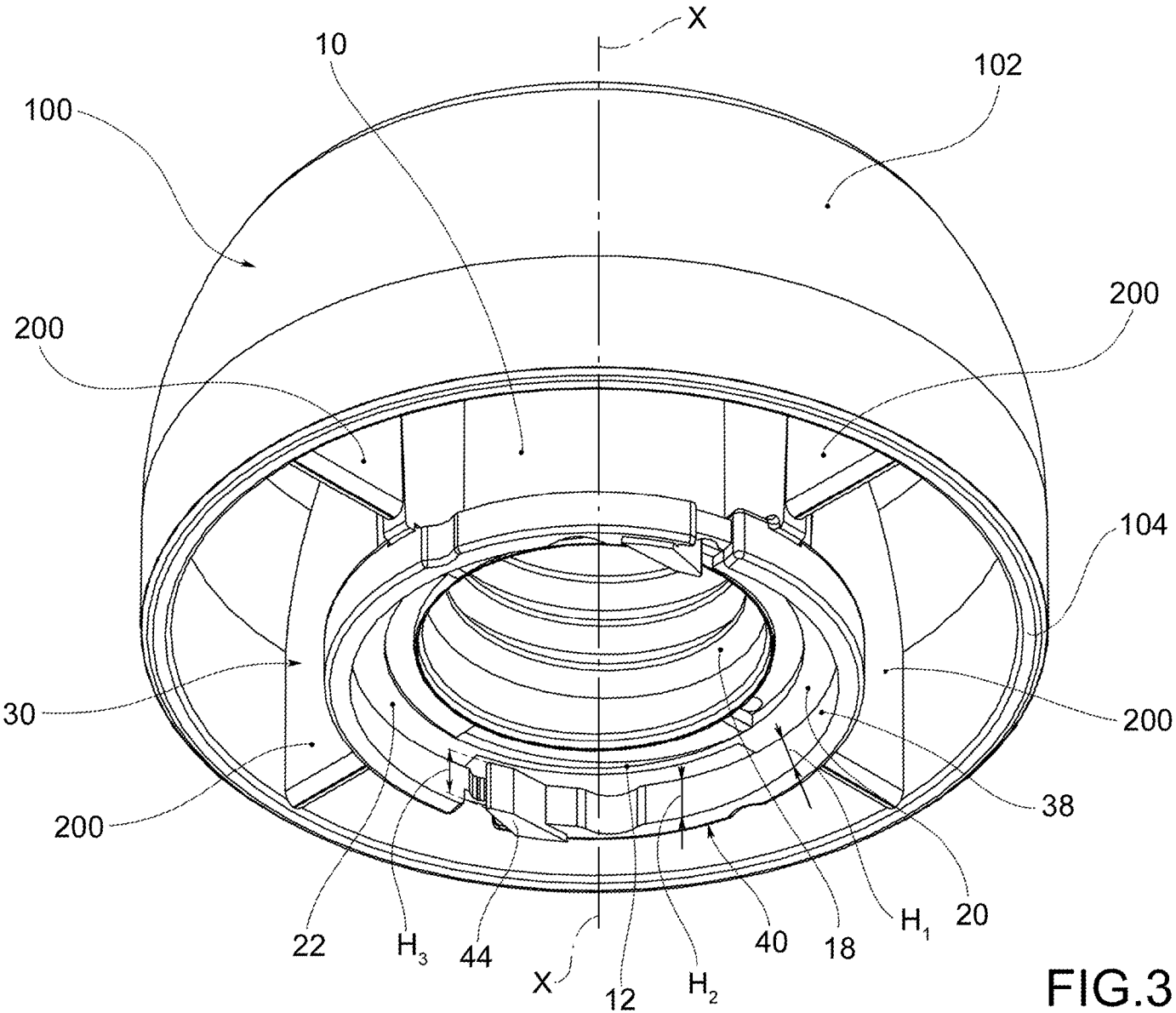
FIG. 3 shows a cap according to an embodiment of the present invention.
Figure 4:
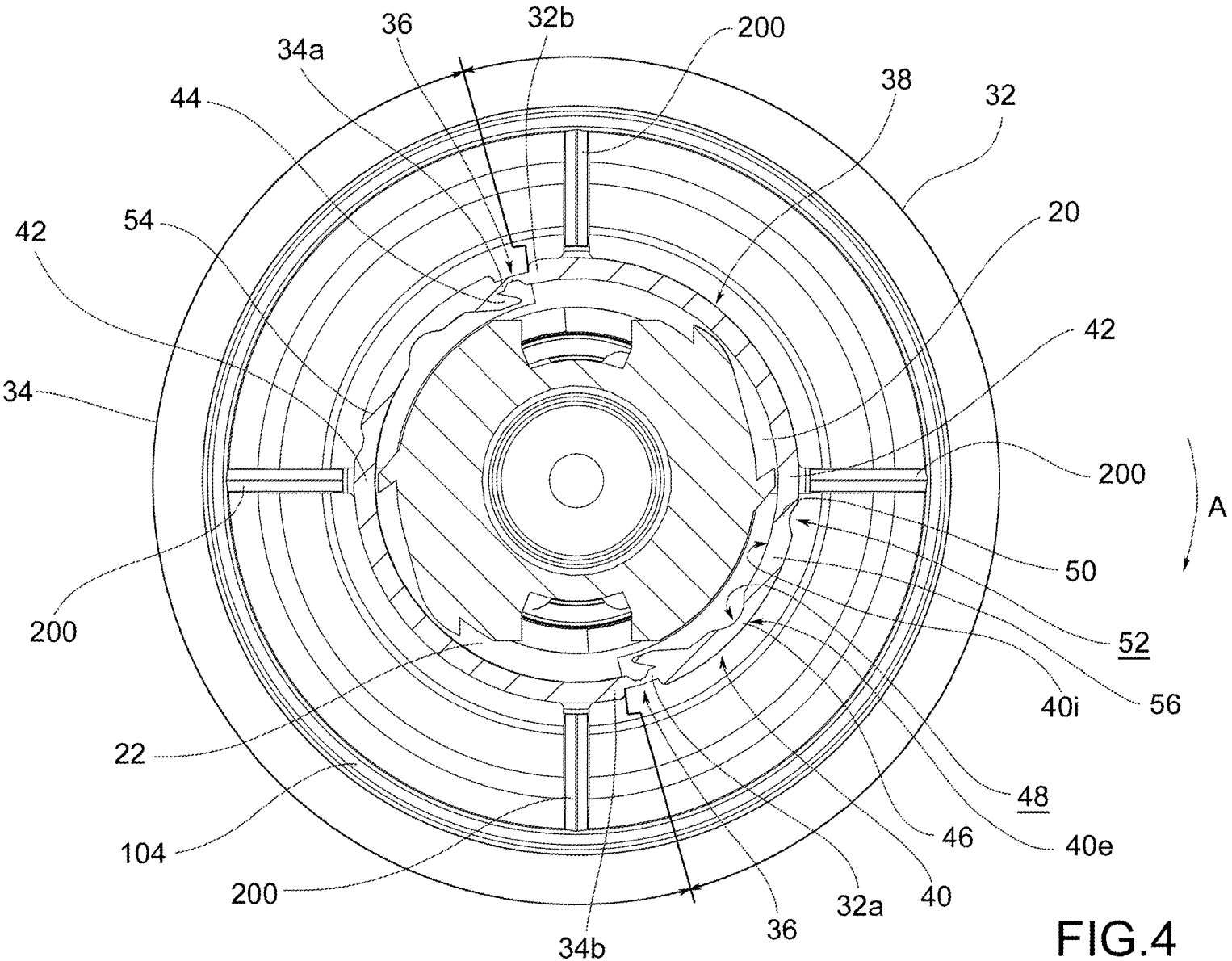
FIG. 4 shows a cross-sectional view of the cap of FIG. 3, applied to the spout part of FIG. 2*a*, in an unbroken seal configuration.
Figure 5:
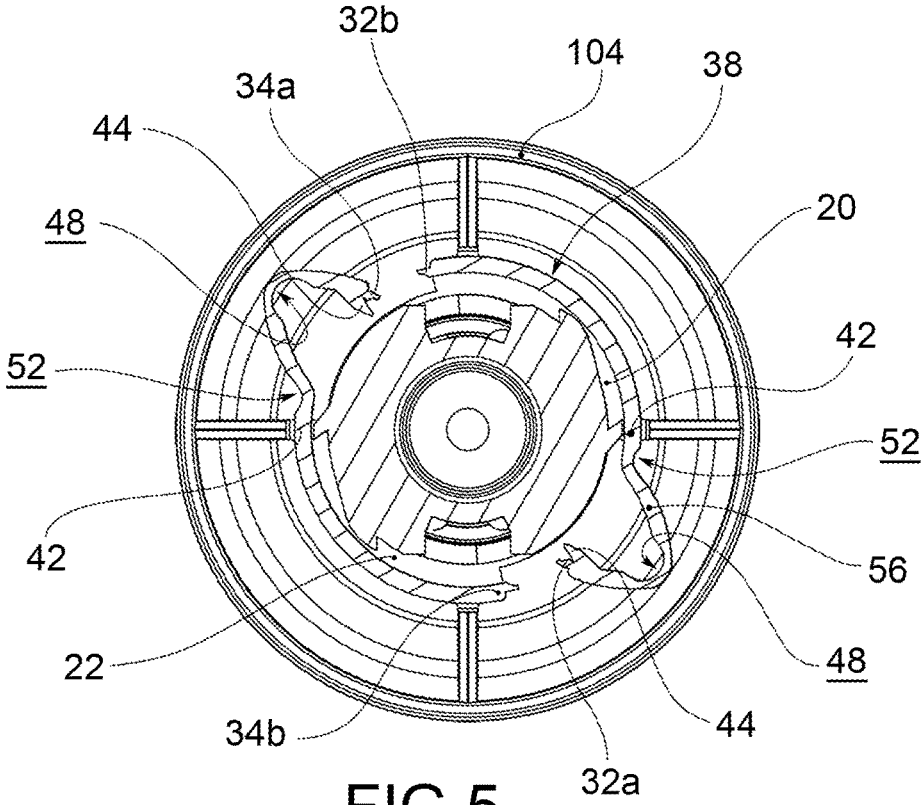
FIG. 5 shows the cap of FIG. 4, in an initial broken seal configuration.

With reference to the figures of the accompanying drawings, reference numeral 1 denotes as a whole a flexible thin-walled package comprising a flexible bag 2 for containing the product, a spout part 4 applied to the bag and a cap 6 screwed to the spout part 4.

Preferably, the bag 2 comprises a first wall 2*a* and a second wall 2*b*, facing the first wall and welded thereto along the respective peripheral edges, except in a functional segment 2*c* to which the spout part 4 is applied. Said walls 2*a*, 2*b* consist of a thin, monolayer or multilayer film, preferably having barrier properties with respect to gases. According to an embodiment variant, the bag 2 comprises one or two lateral sides or a bottom; the sides and the bottom are also made of a flexible film.

The spout part 4, made in a single piece of plastic material, for example by injection molding, comprises a connecting portion 4*a*, referred to as "welding rim," intended for welding in the functional segment 2*c* with the walls 2*a*, 2*b* of the bag 2, a lower flange 4*b*, which delimits the connecting portion 4*a* at the top, an upper flange 4*c*, axially spaced from the lower flange 4*b*, and a spout 4*d* consisting of an annular spout wall 4*e*, ending with a spout edge 4*f* which delimits a mouth 4*g*. The spout 4*d* is provided with a spout thread 5.

The spout part 4 is crossed by a through spout duct 4*i*, which extends along a spout axis Z between the mouth 4*g* and the connecting portion 4*a*.

The spout part 4 further comprises a plurality of fixed ridges 4*h*, for example arranged between the upper flange 4*c* and the spout 4*d*, suitable for engaging a tamper evident seal during a cap unscrewing step.

The cap 6, made in a single piece of plastic material, for example by injection molding, comprises a closure 8 comprising an annular main wall 10 having a central axis X; the main wall 10 extends between an open lower end 12 for the insertion of the spout 4*d*, and an upper end 14 closed by a base 16 of the closure 8.

Internally, the main wall 10 has a thread 18 for screwing the closure 8 to the spout part 4. When the cap 6 is screwed to the spout part 4, the spout axis Z of the spout 4*d* coincides with the central axis X of the cap 6.

At the lower end 12, the closure 8 has a first circular sector 20 and a second circular sector 22, projecting radially externally, substantially orthogonal to the central axis X.

The cap 6 further comprises a tamper evident seal 30 suitable for highlighting the first opening, arranged at the lower end 12 of the main wall 10, jointed with the closure 8 by means of said sectors 20, 22.

Preferably, the cap 6 comprises a shell 100, consisting of an annular shell wall 102, coaxial to the closure 8, circumferentially continuous or formed by separate portions, which surrounds the closure 8, radially spaced therefrom. Preferably, the shell 100 is tapered from the lower end 12 toward the upper end 14.

Axially, i.e. in the direction of the central axis X, the shell wall 102 extends between a lower edge 104, on the side of the lower end 12, and an upper edge 106, on the side of the upper end 14, which defines an upper opening 106*a* of the shell 100.

Preferably, the tamper evident seal 30 projects from the bottom of the shell 100, i.e. it is arranged below the lower edge 104 of the shell wall 102. Furthermore, the base 16 of the closure 8 is preferably contained inside the shell 100, i.e. it is arranged below the upper edge 106 of the shell wall 102.

Furthermore, the cap 6 preferably comprises a plurality of flaps 200, for example four in number, for example angularly equally spaced, which join the shell 100 to the closure 8. Each flap 200 extends on an imaginary plane on which the central axis X lies and at an outer radial end it is joined to the inner surface of the shell wall 102 and at an inner radial end it is joined to the outer surface of the main wall 10.

Anti-suffocation passages 300 open between the shell wall 102 and the main wall 10, passing through the cap.

The tamper evident seal 30 comprises a plurality of main sections, for example, according to a first embodiment (FIGS. 3 to 10), the seal 30 consists of a first main section 32 and a second main section 34. The rotation of the cap in an opening direction A causes first the engagement of the cap with the ridges 4*h* of the spout part 4 and then, continuing in the rotation, the breakage of the tamper evident seal.

Each main section 32, 34 circumferentially extends from a first section end 32*a*, 34*a* or downstream end (with reference to the opening direction A) to a second section end 32*b*, 34*b* or upstream end, and at the first section end 32*a*, 34*a*, comprises a breakable bridge 36 which, in an unbroken seal configuration, temporarily joins it to the second end 34*b*, 32*b* of the other main section 34, 32.

Preferably, at least one of said flaps 200 projects from the main wall 10 of the closure 8 close to the second section end 32*b*, 34*b* of each main section 32, 34.

Each main section 32, 34 comprises a fixed segment 38 and a functional segment 40, in which the functional segment 40 is arranged in succession to the respective fixed segment 38, downstream thereof.

The fixed segment 38, consisting of a band which extends circumferentially, has a substantially constant fixed segment height H1, i.e. an axial dimension, and is directly constrained to the main wall 10 or to the shell wall 102 even in the broken seal configuration.

For example, according to the embodiment shown, the fixed segment 38 is directly constrained to the main wall 10 by means of one of said sectors 20, 22 of the closure 8. In this embodiment, in particular, the fixed segment 38 extends from the second end 32*b*, 34*b* of the main section 32, 34, to an intermediate position 42, at which the sector 20, 22 ends. Preferably, at least one of said flaps 200 projects from the main wall 10 of the closure 8 close to the circumferential position of said intermediate position 42.

The functional segment 40, consisting of a band which extends circumferentially, has a substantially constant functional segment height H2, i.e. an axial dimension and extends from the intermediate position 42 to the first section end 32*a*, 34*a* of the main section 32, 34. In the broken seal configuration, the functional segment 40 remains constrained only to the fixed segment 38, to which it is joined by means of said intermediate position 42, while it detaches from the other main section 34, 32 due to the breakage of the bridge 36 placed at the first section end 32*a*, 34*a*.

Each main section 32, 34 comprises a tooth 44 for engaging, during the unscrewing of the cap 6 from the spout part 4, a respective ridge 4*h* of the spout part 4. Said tooth and said ridge are mutually configured to generate, when mutually engaged and under the action of the unscrewing torque, an action on the tooth directed radially externally, facilitating the bending of the functional segment.

Said tooth 44, consisting of a sharp solid element, has a substantially constant tooth height H3, radially projects inward from the respective functional segment 40 of the main section 32, 34 and is arranged upstream of the first section end 32*a*, 34*a*.

According to a preferred embodiment, the tooth height H3 is greater than the functional segment height H2, which in turn is substantially equal to the fixed segment height H1. In particular, the tooth 44 is level with the functional segment 40 and the fixed segment 38 at the top, while said tooth 44 projects below with respect to the functional segment 40 and the fixed segment 38.

Advantageously, this ensures greater strength of the tooth, which prevents it from detaching from the rest of the tamper evident seal during the breaking of the seal itself.

The functional segment 40 further comprises weakening means suitable for reducing the structural strength of the functional segment locally to obtain lead-in folding points.

According to a first embodiment (FIGS. 3 to 7), the functional segment 40 has an inner face 40*i* facing inward and an opposite outer face 40*e*, and said weakening means comprise a first constriction 46 of the resistant section of the functional segment 40, defined by an inner recess 48 placed on the inner face 40*i*, placed upstream of the tooth 44.

Preferably, moreover, said weakening means comprise a second constriction 50 of the resistant section of the functional segment 40, defined by an outer recess 52 placed on the outer face 40*e*, placed upstream of the first constriction 46. Preferably, said second constriction 50 is placed in proximity to the intermediate position 42.

For the functional segment 40 it is therefore possible to identify a first branch 54 or downstream branch, which extends from the first section end 32*a*, 34*a* to the first constriction 46 and a second branch 56 or upstream branch, which extends from the first constriction 46 to the second constriction 50.

Figure 6:
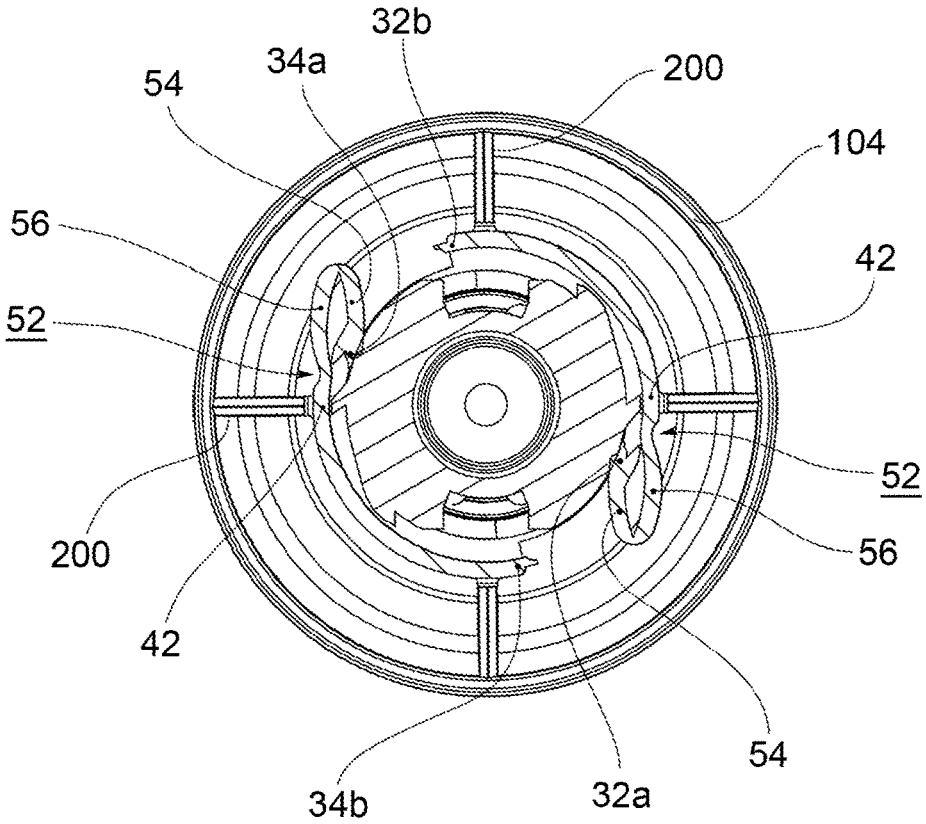
FIGS. 6 and 7 show the cap of FIG. 4, in a final broken seal configuration.
Figure 7:
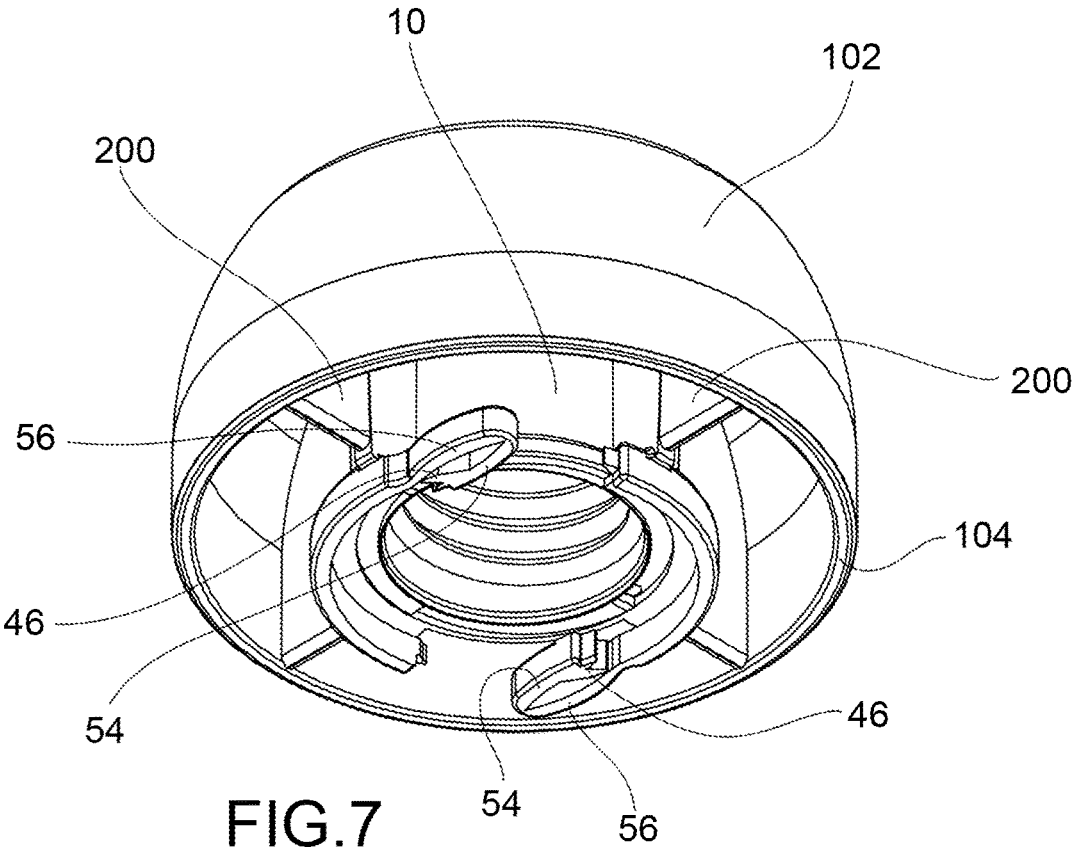
Figure 8:
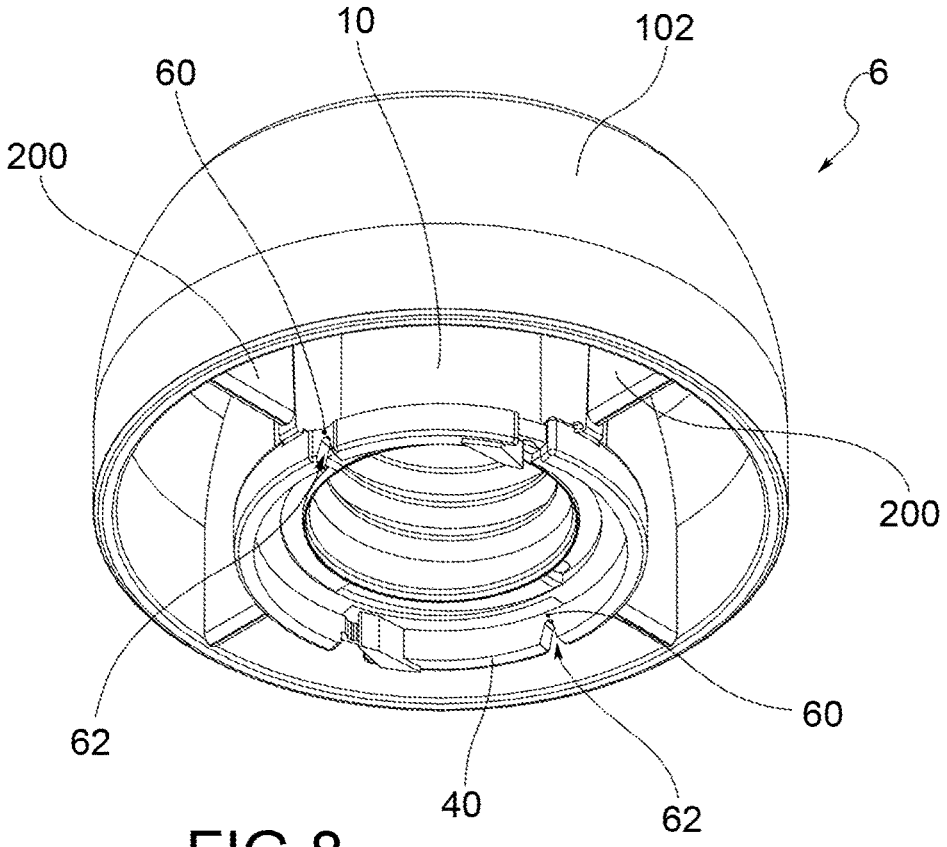
FIG. 8 shows a cap according to a further embodiment of the present invention.
Figure 9:
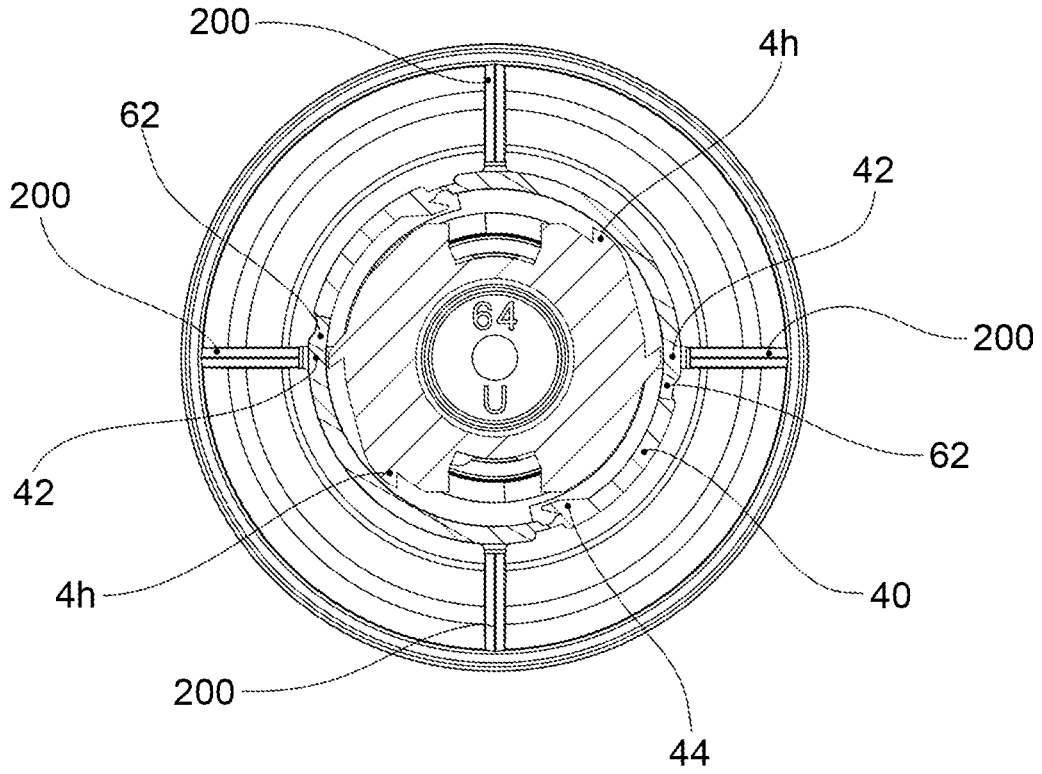
FIG. 9 shows a cross-sectional view of the cap of FIG. 8, applied to the spout part of FIG. 2*a*, in an unbroken seal configuration.
Figure 10:
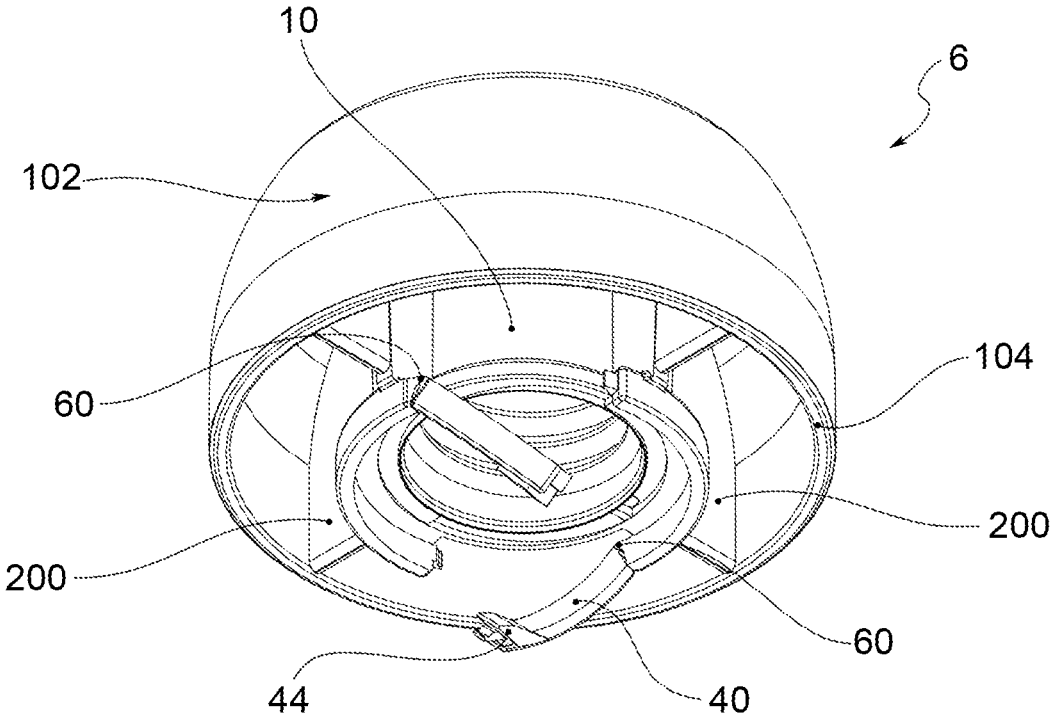
FIG. 10 shows the cap of FIG. 9, in a final broken seal configuration.

During the unscrewing of the cap 6 from the spout part 4, when the tooth 44 engages with the ridge 4*h*, an action is generated on the tooth 44 directed radially outward, which causes the second branch 56 to rotate outward (FIG. 5) and then the folding of the first branch 54 inside the second branch (FIG. 6). This results in such a deformation of the functional segment that, once the cap 6 is screwed back onto the spout part, the breaking remains very evident.

According to a further embodiment (FIGS. 8 to 10), the functional segment 40 has a lower face 40inf facing downward, and said weakening means comprise a constriction 60 of the resistant section of the functional segment 40 defined by a lower recess 62 placed on the lower face 40inf, placed upstream of the tooth 44. Preferably, the constriction 60 is placed in proximity to the intermediate position 42.

During the unscrewing of the cap 6 from the spout part 4, when the tooth 44 engages with the ridge 4*h*, an action is generated on the tooth 44 which causes the downward rotation of the functional segment 40, triggered by the constriction 60. This results in such a displacement of the functional segment from the unbroken seal configuration that, once the cap 6 is screwed back onto the spout part, the breaking remains very evident.

Figure 11:
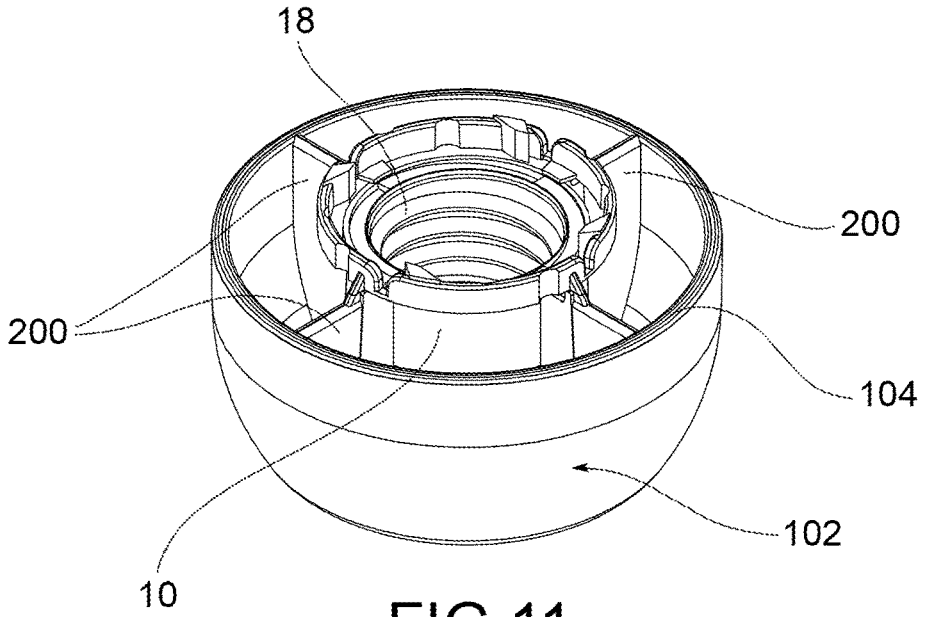
FIG. 11 shows a cap according to a further embodiment of the present invention.
Figure 12:
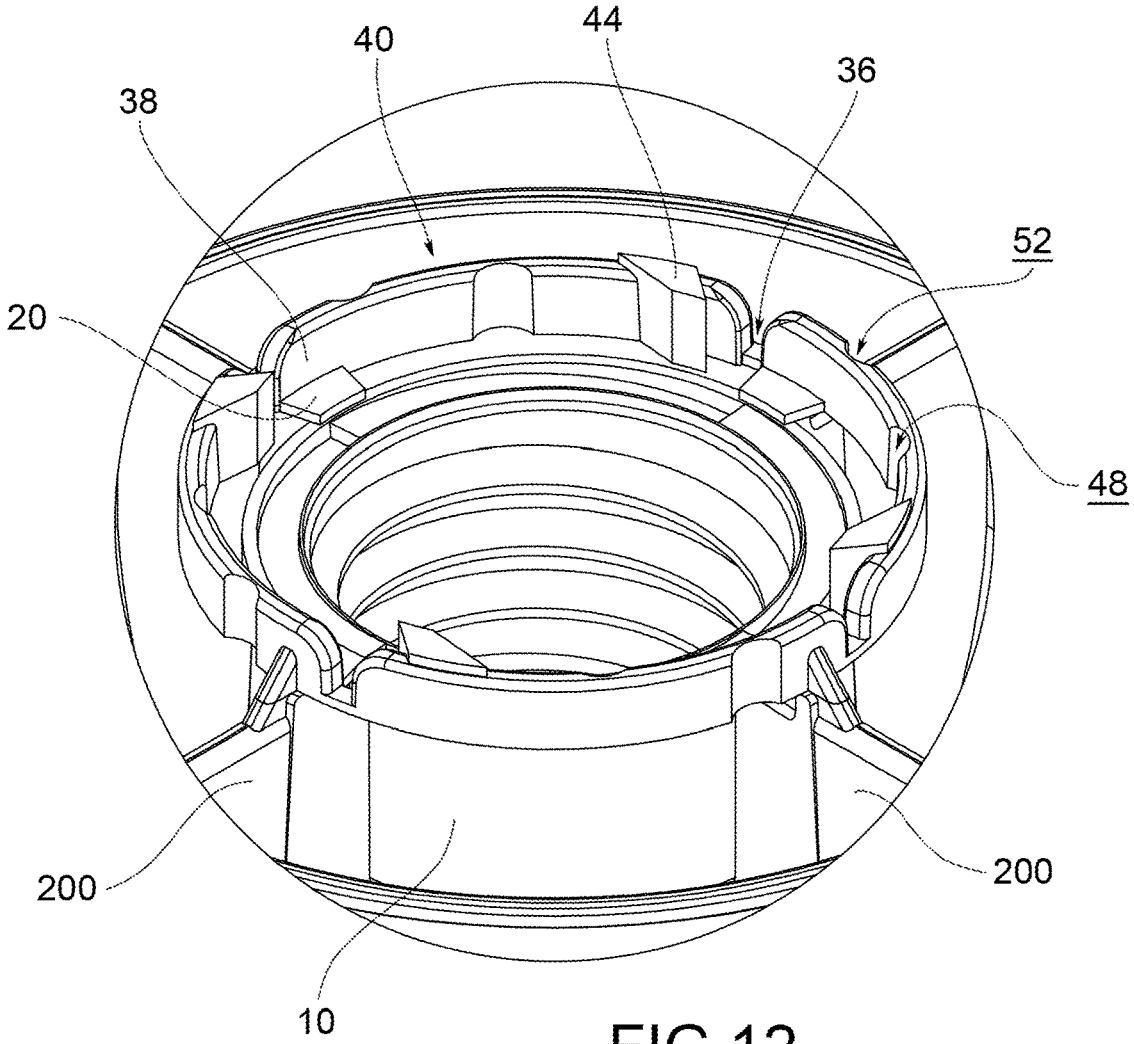
FIG. 12 shows an enlargement of a region of FIG. 11, which highlights the tamper evident seal.
Figure 13:
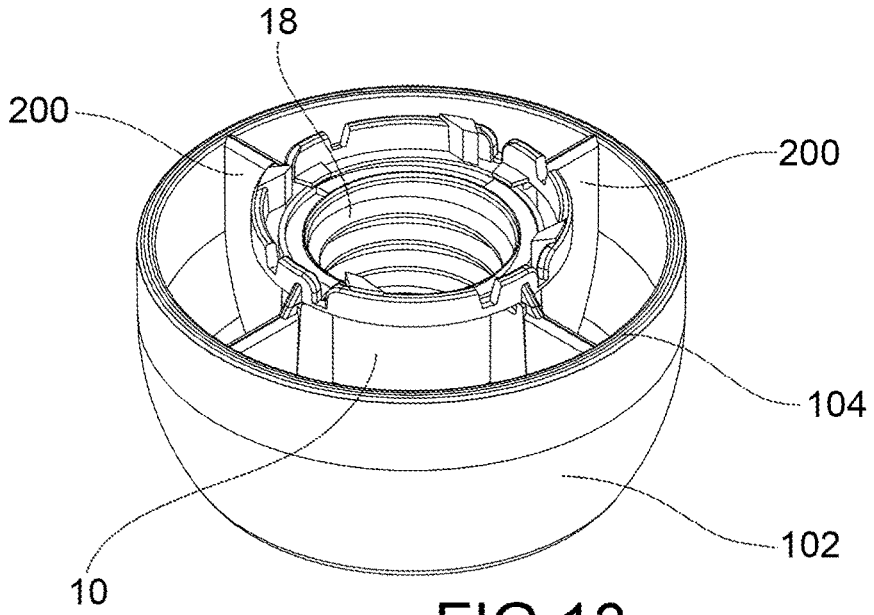
FIG. 13 shows a cap according to a further embodiment of the present invention.
Figure 14:
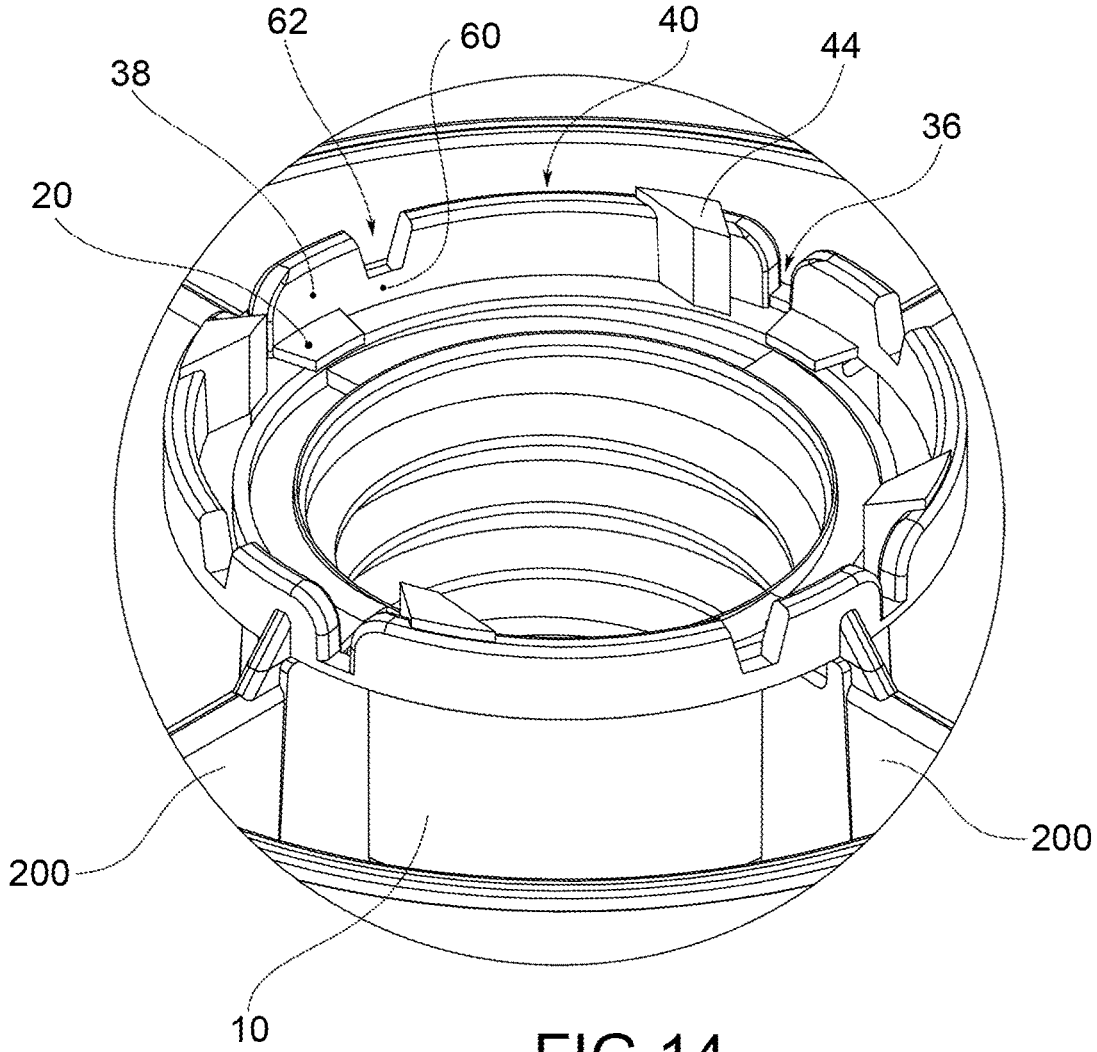
FIG. 14 shows an enlargement of a region of FIG. 13, which highlights the tamper evident seal.

According to a still further embodiment (FIGS. 11 and 12, 13 and 14), the tamper evident seal 30 comprises four main sections. For example (FIGS. 11 and 12), each functional segment has two constrictions, the first on the inner face and the second on the outer face. According to a further example (FIGS. 13 and 14), each functional segment has a constriction on the lower face.

According to an embodiment variant (not shown), the fixed segment of a main section of the tamper evident seal has a different height from the functional segment of said main section.

Innovatively, the cap according to the present invention overcomes the drawbacks mentioned with reference to the prior art, since the tooth of the tamper evident seal is strong enough not to separate during unscrewing, even in low temperature conditions.

Advantageously, moreover, the tamper evident seal, by virtue of the constrictions, is able to clearly highlight the breaking, thus making it clear to the consumer.

It is clear that those skilled in the art may make changes to the cap described above in order to meet incidental needs, all falling within the scope of protection defined in the following claims.

What is claimed is:

1. A cap for a spout of a flexible thin-walled package, comprising:

a closure comprising an annular main wall extending along a central axis between an open lower end and a closed upper end, and a plurality of circular sectors radially projecting outward from the open lower end; and a tamper evident seal at the open lower end of the annular main wall, which is jointed with the closure by said plurality of circular sectors, the tamper evident seal comprising a plurality of main sections, wherein:

i) each main section of the plurality of main sections circumferentially extends from a first section end to a second section end, and at the first section end, comprises a breakable bridge which, in an unbroken seal configuration, joins it to the second section end of another main section of the plurality of main sections;

ii) each main section of the plurality of main sections comprises a fixed segment and a functional segment, joined in succession to the fixed segment, wherein the fixed segment, consisting of a band extending circumferentially, has a fixed segment height and is directly constrained to the annular main wall even in a broken seal configuration by one of said plurality of circular sectors, and the functional segment, consisting of a band extending circumferentially, has a functional segment height, extends from the fixed segment to the first section end of the main section and in the broken seal configuration remains constrained only to the fixed segment and is separated from the other main section due to breakage of the breakable bridge; and iii) each main section of the plurality of main sections comprises a tooth for engaging a respective fixed ridge of the spout, wherein said tooth is arranged upstream of the first section end, radially projects inward from the functional segment, consists of a pointed solid element, and has a tooth height greater than the functional segment height.

2. The cap of claim 1, wherein the tooth is level with the functional segment and the fixed segment at the top, and projects below with respect to the functional segment and the fixed segment.

3. The cap of claim 1, wherein the functional segment comprises weakening means for reducing a structural strength of the functional segment locally to obtain lead-in folding points.

4. The cap of claim 3, wherein the functional segment comprises an inner face facing inward and an opposite outer face, and said weakening means comprise a first constriction of a resistant section of the functional segment, defined by an inner recess placed on the inner face, placed upstream of the tooth.

5. The cap of claim 4, wherein said weakening means comprise a second constriction of the resistant section of the functional segment, defined by an outer recess placed on the outer face, placed upstream of the first constriction.

6. The cap of claim 5, wherein the functional segment comprises a lower face facing downward, and said weakening means comprise a constriction of the resistant section of the functional segment defined by a lower recess placed on the lower face, placed upstream of the tooth.

7. The cap of claim 1, wherein the tamper evident seal consists of two main sections.

8. The cap of claim 1, wherein the tamper evident seal consists of four main sections.

9. The cap of claim 1, further comprising a shell comprising an annular shell wall, circumferentially continuous or consisting of separate portions, which surrounds the closure, radially spaced therefrom.

10. The cap of claim 9, wherein in direction of the central axis, the annular shell wall extends between a lower edge and an upper edge delimiting an upper opening.

11. The cap of claim 9, wherein the tamper evident seal projects from a bottom of the shell.

12. The cap of claim 9, further comprising a plurality of flaps joining the shell to the closure, wherein each flap of the plurality of flaps extends on an imaginary plane on which the central axis lies.

13. The cap of claim 12, wherein at least one of said flaps projects from the annular main wall of the closure close to the second section end of each main section.

14. A cap-spout assembly for a flexible bag of the flexible thin-walled package, comprising:

a spout part in a single piece of plastic material, comprising a connecting portion to be welded to the flexible bag, the spout consisting of an annular spout wall externally provided with a spout thread and a plurality of fixed ridges; and the cap of claim 1;

wherein the plurality of fixed ridges of the spout part are for engaging the tamper evident seal of the cap during a step of unscrewing the cap.

15. The flexible thin-walled package comprising:

the flexible bag; and the cap-spout assembly of claim 14;

wherein the connecting portion of the spout part is welded to the flexible bag.

16. A cap for a spout of a flexible thin-walled package, comprising:

a closure comprising an annular main wall extending along a central axis between an open lower end and a closed upper end, and a plurality of circular sectors, radially projecting outward from the open lower end; and a tamper evident seal at the open lower end of the annular main wall, which is jointed with the closure by said plurality of sectors, the tamper evident seal comprising a plurality of main sections, wherein:

i) each main section of the plurality of main sections circumferentially extends from a first section end to a second section end, and at the first section end, comprises a breakable bridge which, in an unbroken seal configuration, joins it to the second end of another main section of the plurality of main sections;

ii) each main section of the plurality of main sections comprises a fixed segment and a functional segment, joined in succession to the fixed segment, wherein the fixed segment is directly constrained to the annular main wall even in a broken seal configuration by one of said plurality of sectors, and the functional segment extends from the fixed segment to the first section end of the main section and in the broken seal configuration remains constrained only to the fixed segment and is separated from the other main section due to breakage of the breakable bridge;

iii) each main section of the plurality of main sections comprises a tooth for engaging a respective fixed ridge of the spout, wherein said tooth is arranged upstream of the first section end and radially projects inward from the functional segment; and iv) the functional segment comprises weakening means for reducing a structural strength of the functional segment locally to obtain lead-in folding points.

17. The cap of claim 16, wherein the functional segment comprises an inner face facing inward and an opposite outer face, and said weakening means comprise a first constriction of a resistant section of the functional segment, defined by an inner recess placed on the inner face, placed upstream of the tooth.

18. The cap of claim 17, wherein said weakening means comprise a second constriction of the resistant section of the functional segment, defined by an outer recess placed on the outer face, placed upstream of the first constriction.

19. The cap of claim 18, wherein the functional segment comprises a lower face facing downward and said weakening means comprise a constriction of the resistant section of the functional segment defined by a lower recess placed on the lower face, placed upstream of the tooth.

20. A cap-spout assembly for the flexible bag of the flexible thin-walled package, comprising:

a spout part in a single piece of plastic material, comprising a connecting portion to be welded to the flexible bag, the spout consisting of an annular spout wall externally provided with a spout thread and a plurality of fixed ridges; and the cap of claim 16;

wherein the plurality of fixed ridges of the spout part are for engaging the tamper evident seal of the cap during a step of unscrewing the cap.

21. The flexible thin-walled package comprising:

the flexible bag; and the cap-spout assembly of claim 20;

wherein the connecting portion of the spout part is welded to the flexible bag.

* * * * *